United States Patent [19]

Gurule

[11] 4,073,525

[45] Feb. 14, 1978

[54] DOOR LATCH SECURING DEVICE

[76] Inventor: Marcelo Gurule, 605 - 49th St. NW., Albuquerque, N. Mex. 87105

[21] Appl. No.: 804,937

[22] Filed: June 9, 1977

[51] Int. Cl.[2] ..... E05C 13/02

[52] U.S. Cl. ..... 292/346; 292/150

[58] Field of Search ..... 292/150, 346, 264, 288, 292/1

[56] References Cited

U.S. PATENT DOCUMENTS

| | | | |
|---|---|---|---|
| 1,126,375 | 1/1915 | Brinkerhoff | 292/150 |
| 3,426,418 | 2/1969 | Maloney | 70/466 X |
| 3,762,752 | 10/1973 | Saunders | 292/264 |

*Primary Examiner*—Richard E. Moore
*Attorney, Agent, or Firm*—William C. Babcock

[57] ABSTRACT

Apparatus for securing the latch bolt of a conventional door lock against unauthorized withdrawal including a pin assembly provided with a handle, wherein the pin assembly can be alternately stored in a retainer plate or secured thereby in a locked position. More specifically the retainer plate includes an opening conformed to receive the pin of the pin assembly, said opening being aligned with a bore extending through the door into the latch bolt. Adjacent the opening there is provided in the retainer plate a storage hoop which is conformed to function both to store the pin assembly and to secure the handle when inserted.

3 Claims, 6 Drawing Figures

FIG. 1
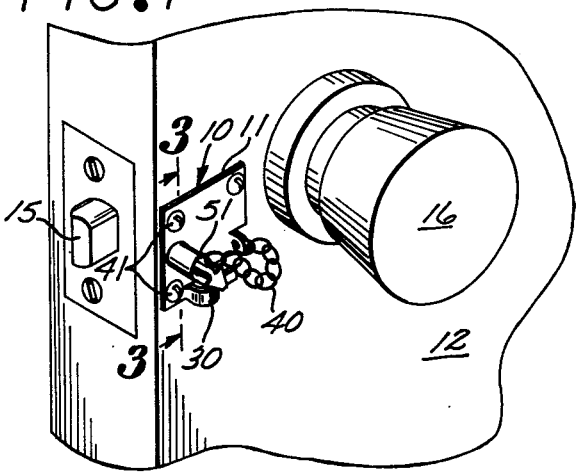
FIG. 2
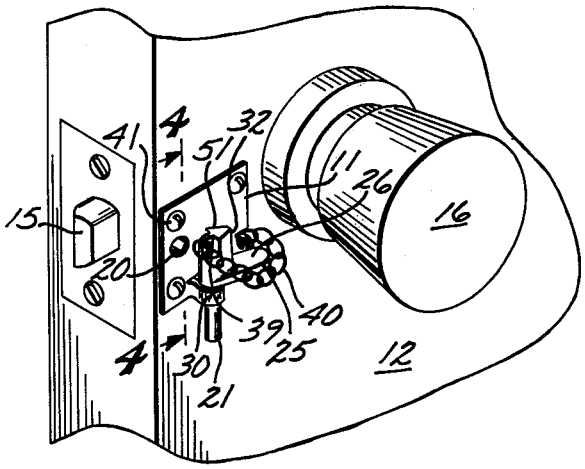
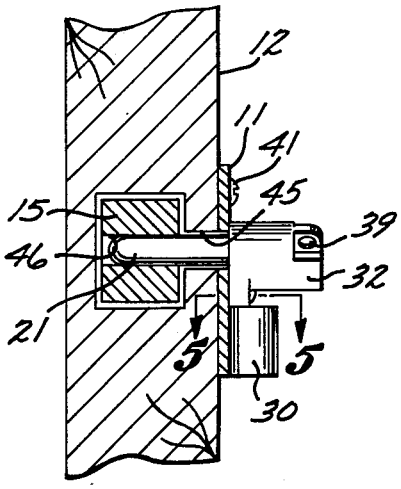
FIG. 3
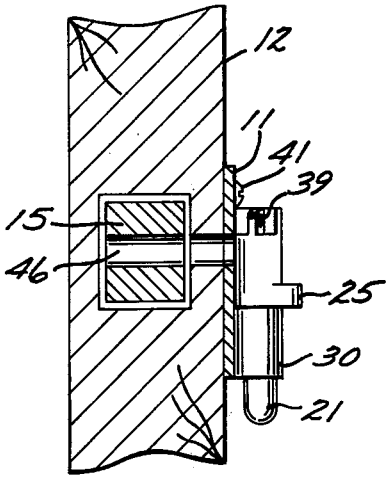
FIG. 4
FIG. 5
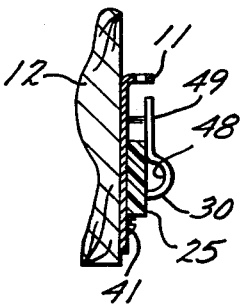
FIG. 6
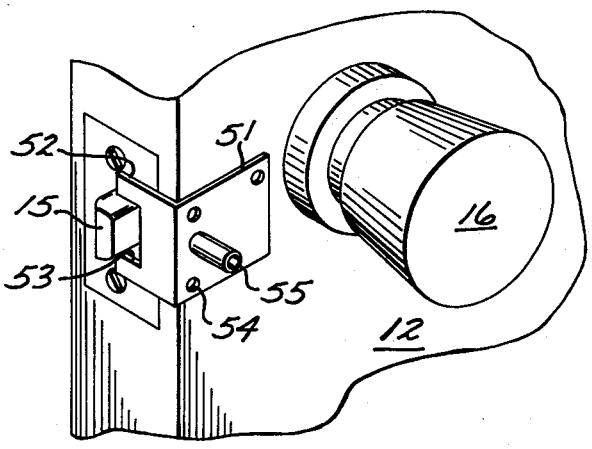

DOOR LATCH SECURING DEVICE

BACKGROUND OF THE INVENTION

1. Field of the Invention

The present invention relates to door securing devices, and more particularly to modifications thereto securing a door lock against unauthorized withdrawal.

2. Description of the Prior Art

With the recent increase in crime against property, various devices for securing doorways against unauthorized entry have appeared in the market. Of these, the after market modifications appears to be most attractive in view of the prevailing use by the public of standardized door locks. Typical of these after market modification kits are those shown in U.S. Pat. No. 3,318,123 wherein a plate is pivoted along the edge of the door to engage a groove in the latch bolt provided therefor. Alternatively replacement door lock assemblies have been provided, such as that shown in U.S. Pat. No. 2,593,573.

In the first instance, the disposition of the added mechanism on the edge of the door while suitable for its purpose, allows for unauthorized opening by the insertion of a thin tool like a screwdriver or credit card to lift this device off its engaging position. In the second instance the cost of purchasing the redundant structure of a modified door lock and the attendant necessity of discarding the original door lock assembly have militated against wide acceptance of the alternative device. Most other prior art devices fall generally into these two classes. For example, the device shown in U.S. Pat. No. 3,773,369 and the assembly shown in No. 3,095,724 each again illustrates the general approach to the problem in the market place.

SUMMARY OF THE INVENTION

Accordingly, it is the general purpose and object of the present invention to provide an after market modification by which conventional door lock may be made secure.

Other objects of the invention are to provide a door latch securing device which is conveniently adapted for installation onto a conventional door lock.

Yet further objects of the invention are to provide a securing device which is convenient in use and more particularly convenient in installation by way of limited and commonly available tooling.

Briefly these and other objects are accomplished within the present invention by providing a substantially rectangular retainer plate including a plurality of mounting holes in the surface thereof and provided with a storage hoop conformed from a portion of said plate. Suspended from the plate by a chain or other similarly flexible connection is a pin assembly comprising a cylindrical pin received in a handle where the handle, in turn, includes a latching detent extending radially therefrom. To facilitate use of the apparatus described above, the retainer plate includes a pin receiving opening which, at installation, is aligned coincident with a pin receiving bore expending through the door and the subjacent latch bolt.

In order to achieve this alignment of the pin receiving bore and the retainer plate, it is intended to provide a template formed in the manner of an angle which on one segment thereof includes a recess for engaging the latch bolt and on the other surface thereof is provided with the above-mentioned securing hold pattern and a drill bushing for the bore.

By way of this arrangement of parts a conveniently installed device is provided which both includes features for storing the securing pin and for engaging the same pin a locking position.

BRIEF DESCRIPTION OF THE DRAWINGS

FIG. 1 is a perspective illustration of a securing device constructed according to the present invention shown in position adjacent a door lock;

FIG. 2 is yet another perspective illustration of securing device shown in FIG. 1 illustrating the stored position thereof;

FIG. 3 is a sectional view taken along line 3—3 of FIG. 1;

FIG. 4 is a sectional view taken along line 4—4 of FIG. 2;

FIG. 5 is yet another sectional view taken along line 5—5 of FIG. 3; and FIG. 6 is a perspective illustration of a drill template useful with the invention herein.

DESCRIPTION OF THE SPECIFIC EMBODIMENT

While the following description of the inventive securing device is shown in conjunction with a door lock of a particular configuration, it is to be understood that various other locking devices may be similarly modified. The selection of the uses herein is therefore a selection illustrating the best mode and no intent to limit the invention thereby is expressed.

As shown in FIGS. 1 and 2, an inventive securing device, generally designated by the numeral 10, comprises a substantially rectangular retainer plate 11 secured to a door 12 in alignment over the latching bolt 15 extending from a door lock 16. It is to be noted that the latch bolt 15 and the door lock 16 are conventional in the art, bolt 15 being retractable from its extended position by the rotary articulation of the lock 16.

Included in the face of the retainer plate 11 is an opening 20 into which a pin 21 extending from a handle 25 is receivable. Handle 25, furthermore includes a securing detent 26 extending radially from the pin axis thereof, this detent being insertable, by rotation of the pin handle, into the space provided between a pin retaining hook 30 and the plate 11.

To facilitate this turning manipulation, handle 25 includes flats formed thereon shown herein as flats 31 and 32. Furthermore in order to prevent inadvertent loss of the pin assembly both the handle 25 and the plate 11 are provided with attachment openings 39 and 19 respectively between which a chain 40 is disposed.

By reference to FIGS. 3 and 4, plate 11 is attached by a plurality of screws 41 to the interior surface of the door 12, the alignment thereof being such as to align the pin opening 20 therein axially with a bore 45 extending through the door which, in turn, aligns with yet another bore 46 formed in the latch bolt 15. It is to be noted that the alignment of opening 20, bore 45 and bore 46 are with the latch bolt 15 in its extended position. The insertion of pin 21 into the common interior of the bores will therefore maintain the latch bolt extended, in secured engagement against the spring biased inward articulation thereof normally provided.

By further reference to FIGS. 3 and 4 and in particular by reference to FIG. 5 the convolutions in the clip 30 or the support hoop are such as to provide a convenient storage hoop for the pin 21 (shown in FIG. 4) and concurrently a retaining gap for engaging the detent 26 (shown in FIGS. 3 and 5). For this reason, the clip 30 is conformed to provide a circular hoop segment 48 adjacent the juncture of the clip with the plate 11, from which an extension 49 is provided in substantially parallel alignment with the same plate. By virtue of this disposition of parts, the space between extension 49 and the adjacent surface of the plate 11 may be made smaller than the sectional dimensions of detent 26, thus providing a spring biased engagement of the detent on insertion. Thus by virtue of a single assembly both the storage and the latching requirements of the securing device are met each achieved by minimal tooling processes and by minimal expenditures in material cost.

To provide for convenient and error free installation of the device decribed above, described is further contemplated to include a drilling template, generally shown in FIG. 6 as a template 50, said template including two orthogonally joined segments 51 and 52. Segment 52 furthermore includes a cutout 53 proximate the free edge thereof conformed to receive the extended latch bolt of the interior thereof. By virtue of this cutout, the other segment 51 can be aligned on the surface of the door 12 disposing a plurality of fastener pilot holes 54 and a pilot bushing 55 in proper alignment. By virtue of this tool the necessary drilling alignment is made relative the bolt, and very little further mechanical skills are required to achieve installation.

Obviously many modifications and variations to the above disclosure can be made without departing from the spirit of the invention. It is therefore intended that the scope of the invention be determined solely dependent on the claims hereto.

I claim:

1. In a door lock including a latch bolt spring biased for latching a door and handle means for manual articulation of said bolt against the spring bias thereof, the improvement comprising:

a support plate adapted for attachment to the surface of said door in substantial alignment over said latch bolt, said plate including an opening in the face thereof aligned over said bolt and a clip structure extending from said plate proximate one horizontal edge thereof conformed in the manner of a substantially semicircular hoop segment adjacent said plate and a straight segment distal thereof substantially parallel to said plate;

a first and second bore formed respectively in said door and said latch bolt in axial alignment with said opening; and a pin assembly including a pin extending from a handle, said pin being conformed for alternate receipt in said opening and first and second bores and in said hoop segment, and said handle including a detent extending radially from the axis of said pin conformed for receipt between said straight segment and said plate when said pin is inserted in the common interior of said opening and said first and second bore.

2. Apparatus according to claim 1 further comprising:

flexible connecting means attached between said handle and said plate.

3. Apparatus according to claim 2 wherein:

said plate comprises a substantially rectangular planar metal structure; and said clip comprises a partly separated rectangular strip of said plate.

* * * * *